United States Patent [19]

Läubli

[11] 4,031,863

[45] June 28, 1977

[54] PROCESS AND A CONTROL SYSTEM FOR CONTROLLING THE EXIT TEMPERATURE OF VAPOR FLOWING THROUGH A CONTACT HEATING SURFACE OF A VAPOR GENERATOR

[75] Inventor: Fritz Läubli, Winterthur, Switzerland

[73] Assignee: Sulzer Brothers Limited, Winterthur, Switzerland

[22] Filed: Sept. 26, 1975

[21] Appl. No.: 617,063

[30] Foreign Application Priority Data

Sept. 17, 1974 Switzerland ..... 12628/74

[52] U.S. Cl. ..... 122/479 R; 122/487; 236/14

[51] Int. Cl.[2] ..... F22G 5/12

[58] Field of Search ..... 122/406 S, 406 T, 448 S, 122/451 S, 479 S, 487; 236/14

[56] References Cited

UNITED STATES PATENTS

| | | | |
|---|---|---|---|
| 2,966,896 | 1/1961 | Vogler | 122/479 X |
| 3,089,308 | 5/1963 | Halle | 122/448 X |
| 3,096,744 | 7/1963 | Profos | 122/479 |
| 3,134,367 | 5/1964 | Halle | 122/479 X |
| 3,175,541 | 3/1965 | Hottenstine | 122/451 |

*Primary Examiner*—Kenneth W. Sprague
*Attorney, Agent, or Firm*—Kenyon & Kenyon, Reilly, Carr & Chapin

[57] ABSTRACT

Measurements of the instantaneous flow of heat delivered to the vapor generator and the quantity of vapor flowing momentarily through the contact heating surface are made and the resultant signals are compared by subtraction or division to obtain a comparison signal. The comparison signal is then imposed on a control element in the form of a valve to cause an injection of more or less water into the vapor flowing into the heating surface in order to regulate the exit temperature of the vapor.

14 Claims, 1 Drawing Figure

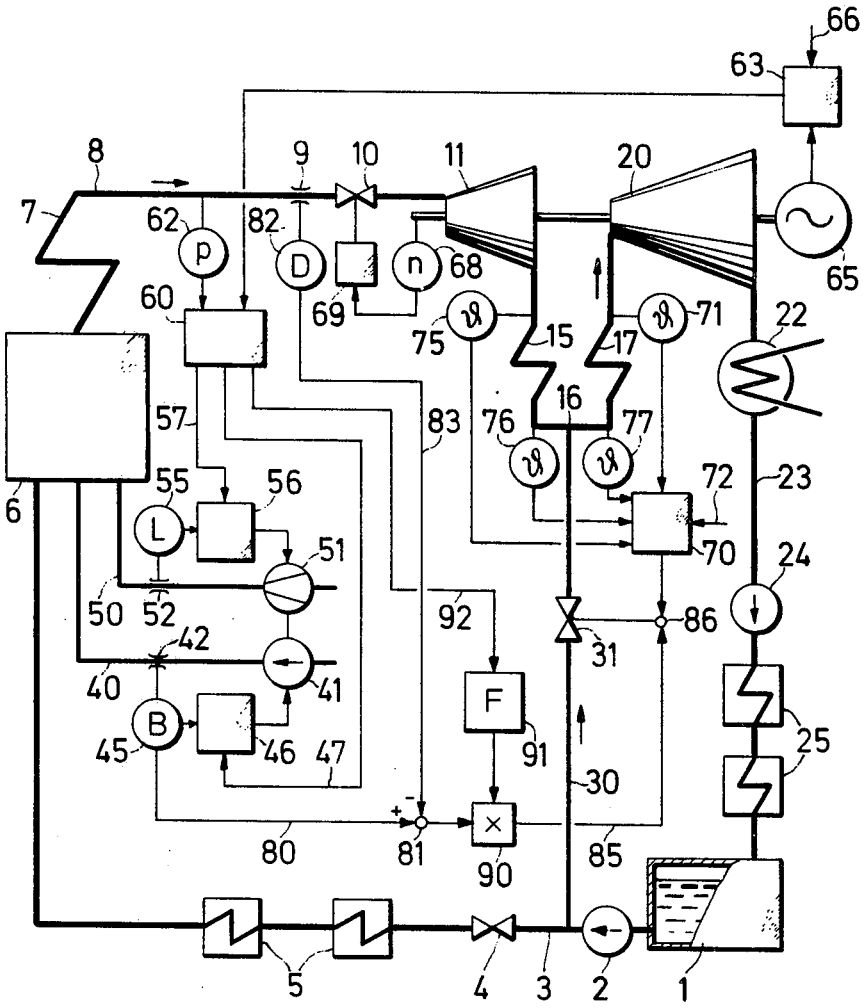
66
63
8
9
10
11
20
7
62
82
P
D
n
68
65
60
69
75
15
17
71
22
16
57
83
76
77
6
55
56
72
23
L
51
70
24
50
52
92
86
42
31
40
41
F
B
91
25
45
46
47
30
80
81
90
85
5
4
3
2
1

PROCESS AND A CONTROL SYSTEM FOR CONTROLLING THE EXIT TEMPERATURE OF VAPOR FLOWING THROUGH A CONTACT HEATING SURFACE OF A VAPOR GENERATOR

This invention relates to a process and a control system for controlling the exit temperature of vapor flowing through a contact or convection heating surface of a vapor generator.

As is known, the temperature at which a vapor leaves a contact heating surface of a vapor generator must be controlled and such is usually done through the injection of water. In the case of sliding pressure vapor generators or of abrupt changes in load, particularly if the vapor generator is a forced-flow vapor generator, difficulties may occur because the vapor exit temperature cannot be readily maintained within the close limits essential for high-temperature, and therefore, high-efficiency operation.

Accordingly, it is an object of the invention to enable the vapor associated with a contact heating surface of a vapor generator to be kept nearer to its reference value than has previously been possible.

It is another object of the invention to achieve a high operating efficiency in a vapor generator in a relatively simple manner.

It is another object of the invention to avoid subjecting the components of a vapor generator downstream of a contact heating surface to excessive temperatures or rapid temperature changes when regulating the exit temperature of a vapor leaving the contact heating surface.

Briefly, the invention provides a process and a control system for a vapor generator wherein the exit temperature of the vapor exiting a contact heating surface of the vapor generator is controlled as a function of the heat supplied to the vapor generator and the quantity of vapor flowing to the contact heating surface.

The process includes the steps of obtaining a first signal corresponding to the amount of an instantaneous flow of heat supplied by a fuel, such as a mixture of oil and air, delivered to the vapor generator and a second signal corresponding to the quantity of vapor flowing momentarily through the contact heating surface. Thereafter, the two signals are compared, by subtraction or division, to obtain a comparison signal. The comparison signal, when obtained, is imposed on a control element which acts on the exit temperature of the contact heating surface. For example, the control element may be in the form of a control valve which regulates an amount of water to be injected into the vapor flowing through the contact heating surface. Alternatively, the control element may be in the form of an air controller which regulates the amount of air used for combustion. Other parameters which have an influence of the exit temperature of the vapor from the contact heating surface may also be regulated by the comparison signal.

The formation and application of the comparison signal provide the advantage that changes in vapor exit temperature due to considerable alterations of load can be kept relatively small. Thus, subsequent components in the vapor generator do not have to experience excessive temperatures or excessive rates of temperature change. Conveniently, if there is an additional control of the exit temperature, the comparison signal is also applied to the final control element thus controlled or to the controller acting thereon.

The control system of the invention includes a means for measuring the instantaneous flow of heat, i.e. either the fuel or the air flow, supplied to the vapor generator to obtain a first signal and a means for measuring the quantity of steam flowing through the contact heating surface to obtain a second signal. In addition, the control system includes a comparison means for comparing the signals with each other to obtain a comparison signal and a control element which influences the exit temperature of the vapor exiting from the contact heating surface. This control element is connected to the comparison means to receive the comparison signal and to respond to the comparison signal to maintain the exit temperature of the vapor at a substantially constant value.

These and other objects and advantages will become apparently from the following detailed description and appended drawing taken in conjunction with the accompanying claims in which:

The drawing illustrates a diagrammatic view of a plant for performing the process according to the invention.

Referring to the drawing, feed water is supplied by a feed water pump 2 from a feed water tank 1 through a feed line 3 to a vapor generator 6, e.g. a forced-flow once-through vapor generator. A feed valve 4 and two vapor-heated high pressure preheaters 5 are incorporated in the feed line 3 with the valve 4 controlled in a manner which is known and not shown in great detail. The vapor evolved in the generator 6 passes through a superheater 7, embodied at least to some extent as a contact heating surface, into a live steam line 8 connected to a high-pressure steam turbine 11. The line 8 includes a station 9 for measuring the quantity of live steam and a turbine inlet valve 10.

After partial expansion in the turbine 11, the steam flows through a reheater, subdivided into two consecutive sections 15, 17, to a low-pressure turbine 20. The reheater 15, 17 forms a contact heating surface of the generator 6. The outlet of the turbine 20 is connected to a conductor 22 an outlet of which connects with a condensate line 23 which has a condensate pump 24 and two steam-heated low-pressure pre-heaters 25 incorporated therein and which extends to the tank 1.

An injection water line 30 branches off the feed line 3 between the pump 2 and valve 4 and passes via an injection valve 31 to an injection station 16 which is disposed between the reheater sections 15, 17.

The vapor generator 6 is supplied with oil for combustion via a fuel pump 41 and a fuel line 40 in which a measuring orifice 42 is placed for measuring the quantity of oil. A measuring element 45 is associated with the orifice 42 whose output signal is supplied as an actual-value signal to a fuel controller 46. The controller 46 also receives a fuel quantity set-value signal by way of a signal line 47 from a load sender 60. A control signal is formed in the controller 46 in known manner from the actual-value and set-value signals for fuel quantity and is supplied to the pump 41 in order to vary the oil supply.

The air required for combustion of the oil is supplied to the vapor generator 6 via a blower 51 and line 50 in which a measuring orifice 52 is placed for measuring the air quantity. A measuring element 55 is associated with the orifice 52 whose output signal is supplied as an actual-value to an air controller 56. An air quantity set-value signal is also supplied to the controller 56 by way of a signal line 57 from the load sender 60. A control signal is formed in the controller 56 in known manner from the air set-value and actual-value signals and is supplied to the blower 51 in order to vary the supply of air.

The load sender 60 is also connected on an input side to a live steam pressure measuring element 62 connected to the live steam line 8, and to the output of a power controller 63. The power controller 63 receives an actual value signal representative of the electrical output of a generator 65 driven by the turbines 11, 20. Also, an electric power set-value is supplied to the power controller 63 via a signal line 66.

A tachometer 68 connected to the shaft of the high-pressure turbine 11 controls the turbine inlet valve 10 by way of a controller 69.

The injection valve 31 is controlled in a known manner by a controller 70 which receives as an actual value, the output signal of a temperature sensor 71 disposed in the reheater section 17. A temperature set value is also supplied to the controller 70 via a signal line 72. The controller 70 can receive, in addition to the temperature signal from the sensor 71, other temperature signals, e.g. from a temperature sensor 75 connected to the entry of the reheater section 15, from a temperature sensor 76 connected to the exit of the reheater section 15 and/or from a temperature sensor 77 connected to the entry of the second reheater section 17.

The plant is also provided with a measuring element 82 connected to the steam measuring station 9 to emit an actual value signal corresponding to the quantity of steam, i.e. vapor, flowing momentarily through the reheater 15, 17, i.e. contact heating surface. Both the measuring elements 45, 82 for the oil supply and steam flow are connected via signal lines 80, 83, respectively, to a means 81 for comparing, for example by subtraction, the signals received from each to obtain a comparison signal. The comparison signal is formed as a difference signal and is supplied via a signal line 85 to an addition point 86 for imposition on the injection valve 31 which functions as a final control element acting on the exit temperature of the reheater 15, 17.

To this end, the difference signal is superimposed at the addition point 86 upon the final control signal delivered by the controller 70.

The vapor generator illustrated is operated on the sliding pressure principle. In operation, a live steam pressure set-value which is dependent upon instantaneous load is formed in the load sender 60, such set value increasing substantially linearly with the load in at least one predetermined pressure zone. When the vapor generator 6 is operating in this zone and the electric power set value (in signal line 66) is increased, the vapor generator 6 must be brought to a higher pressure. Accordingly, combustion and feed water quantity are temporarily increased beyond the steady-state values corresponding to the new load, the flow of live steam reaching the new power level with delay. Consequently, a positive signal arises in the comparison means 81 as the difference between the two measured-value signals and acts by way of the signal line 85 to temporarily increase the quantity of water injected via the injection valve 31. It has been found that such a temporary increase in the quantity of injected water avoids any excessively abrupt change in the exit temperature of the reheater section 17.

A multiplication element 90 is disposed in the signal line 85 to receive a load-dependent signal via a function generator 91. The function generator 91 receives a load signal via a signal line 92 from the load sender 60. The function generator 91 is so devised that, in the load ranges in which a relatively large proportion of the total amount of heat evolved by the fuel is yielded to the reheater 15, 17, the comparison signal is imposed at a greater value on the injection valve 31 than in the load ranges where this proportion is relatively small.

As an alternative to the example shown, the multiplication element 90 can be disposed in one of the two signal lines 80, 83 but is preferably disposed in the line 80 from the fuel measuring element 45.

As an alternative, the quantity of air in the line 50 can be used instead of the quantity of fuel to form the first measured-value signal.

Subject to there being no considerable removal of steam between the measuring station 9 and the reheater 15, 17, the second measured-value signal, which corresponds to instantaneous quantity of steam flowing through the contact heating surface and which is formed in the example illustrated by measurement of the quantity of live steam, can be used for the control process. Consequently, the quantity-measuring station which is conventionally provided in the live steam line of existing vapor generator plants can be used for the process. If there be a bleeding point between the station 9 and the reheater 15, 17, the station for measuring the second measured-value signal should be disposed near the reheater 15, 17. Instead of the quantity of steam being used, the second measured-value signal can be formed from the drop in the pressure of the steam flowing along the contact heating surface 15, 17 or from the turbine power or from the steam pressure immediately after the turbine inlet valve 10.

Instead of using the quantity of water injected as the manipulated variable, the excess of air can be used - i.e., the comparison signal can act on the blower 51. If the steam generator has flue gas recirculation, the quantity of such recirculation can be used as the manipulated variable acted on by the comparison signal. If the steam generator has tilting burners, their inclination can be used as the manipulated variable acted upon by the comparison signal.

It is to be noted that the comparison signal can be formed by division, instead of by subtraction, of the first and second measured-value signals.

In addition, where a difference signal is formed as the comparison signal, at least one of the two measured value signals in the lines 80, 83 is multiplied by a factor so that the difference becomes zero when a steady state operation is in effect.

What is claimed is:

1. A process for controlling the exit temperature of vapor flowing through a contact heating surface of a vapor generator, said process comprising the steps of obtaining a first signal corresponding to the amount of an instantaneous flow of heat supplied by a fuel delivered to the vapor generator;

obtaining a second signal corresponding to the quantity of vapor flowing momentarily through the contact heating surface;

comparing said first and second signals to obtain a comparison signal; and imposing said comparison signal on a control element acting on the exit temperature of the contact heating surface.

2. A process as set forth in claim 1 wherein said first and second signals are subtracted from each other to obtain said comparison signal.

3. A process as set forth in claim 1 wherein said first and second signals are divided one by the other to obtain said comparison signal.

4. A process as set forth in claim 1 wherein the quantity of fuel flowing to the vapor generator is measured to obtain said first signal.

5. A process as set forth in claim 1 which further includes the steps of obtaining a temperature control signal from a measurement of the temperature of the vapor at least at the exit from the contact heating surface and imposing said comparison signal on said temperature control signal prior to imposition of said comparison signal on the control element.

6. A process as set forth in claim 1 wherein the control element injects water into the vapor passing through the contact heating surface in response to reception of said comparison signal.

7. A process as set forth in claim 1 which further includes the step of imposing a load-dependent signal on said comparison signal prior to imposition of said comparison signal on the control element whereby in load range in which a relatively large proportion of the total amount of heat evolved by the fuel is yielded to the contact heating surface, said comparison signal is imposed at a greater value on the control element than in a load range where said proportion is relatively small.

8. A process as set forth in claim 7 wherein said load-dependent signal and said comparison signal are multipled together.

9. A process as set forth in claim 7 wherein said load-dependent signal and one of said first and second signals are multiplied together.

10. A process as set forth in claim 1 wherein said first and second signals are subtracted from each other to form a difference signal as said comparison signal, the further step of multiplying at least one of said first and second signals by a factor to eliminate any difference between said first and second signals in a steady-state operating condition of the vapor generator.

11. A process as set forth in claim 1 wherein the vapor generator is a sliding pressure vapor generator and said contact heating surface is a re-heater.

12. A process for controlling the exit temperature of vapor flowing through a contact heating surface of a vapor generator, said process comprising the steps of measuring the amount of heat supplied to the vapor generator to heat the contact heating surface to obtain a first signal;

measuring the quantity of vapor flowing through the contact heating surface to obtain a second signal;

comparing one of said first and second signals with the other of said signals to obtain a comparison signal; and adjusting a control element influencing the exit temperature of the vapor exiting from the contact heating surface in response to said comparison signal to maintain said exit temperature at a substantially constant value.

13. A process for controlling the exit temperature of vapor flowing through a contact heating surface of a vapor generator, said process comprising the steps of measuring the flow of fuel delivered to the vapor generator to obtain a first signal;

measuring the quantity of vapor flowing through the contact heating surface to obtain a second signal;

subtracting one of said first and second signals from the other to obtain a comparison signal; and injecting water into the vapor flowing through the contact heating surface in response to said comparison signal being of positive value to maintain the exit temperature of the vapor from the contact heating surface at a substantially constant value.

14. A control system for a steam generating plant having a vapor generator means for feeding fuel to said vapor generator, and at least one contact heating surface therein for a flow of live steam therethrough, said control system comprising means for measuring the instantaneous flow of heat supplied to said vapor generator to obtain a first signal;

means for measuring the quantity of steam flowing through said contact heating surface to obtain a second signal;

a comparison means for comparing said signals with each other to obtain a comparison signal; and a control element for influencing the exit temperature of the vapor exiting from said contact heating surface, said control element being connected with said comparison means to receive said comparison signal and to respond to said comparison signal to maintain said exit temperature of the vapor at a substantially constant value.

* * * * *